US007007643B2

(12) United States Patent
Afjeh et al.

(10) Patent No.: US 7,007,643 B2
(45) Date of Patent: Mar. 7, 2006

(54) ENGINE VALVE ACTUATION SYSTEM

(75) Inventors: Homa Afjeh, Dunlap, IL (US); Ronald D. Shinogle, Peoria, IL (US); Gregory D. Brock, Peoria, IL (US); Scott A. Leman, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/697,437

(22) Filed: Oct. 31, 2003

(65) Prior Publication Data

US 2004/0123824 A1 Jul. 1, 2004

Related U.S. Application Data

(60) Provisional application No. 60/436,634, filed on Dec. 30, 2002.

(51) Int. Cl.
*F01L 9/02* (2006.01)

(52) U.S. Cl. ..... 123/90.12; 123/90.11; 123/90.39

(58) Field of Classification Search ..... 123/90.11, 123/90.12, 90.13, 90.23, 90.24, 90.25, 90.26, 123/90.39, 90.44; 251/129.01, 129.02, 129.15, 251/129.16, 129.18
See application file for complete search history.

(56) References Cited

U.S. PATENT DOCUMENTS 4,258,671 A * 3/1981 Takizawa et al. ..... 123/90.16
5,529,030 A * 6/1996 Rose ..... 123/90.12
5,537,976 A * 7/1996 Hu ..... 123/322
5,720,261 A * 2/1998 Sturman et al. ..... 123/446
6,237,551 B1 5/2001 Macor et al.
6,257,182 B1 * 7/2001 Hara et al. ..... 123/90.11
6,647,935 B1 * 11/2003 Aoyama et al. ..... 123/90.16
6,688,280 B1 * 2/2004 Weber et al. ..... 123/305
6,691,654 B1 * 2/2004 Uehara et al. ..... 123/90.16
6,807,929 B1 * 10/2004 Bloms et al. ..... 123/90.12
2004/0168658 A1 * 9/2004 Sakai et al.

FOREIGN PATENT DOCUMENTS

| | | |
|---|---|---|
| AT | 002 430 U1 | 10/1998 |
| AT | 003 600 U1 | 5/2000 |
| DE | 3428627 C2 | 2/1986 |
| DE | 297 02 511 U1 | 5/1997 |
| EP | 0 796 982 A1 | 9/1997 |

* cited by examiner

*Primary Examiner*—Thomas Denion
*Assistant Examiner*—Ching Chang
(74) *Attorney, Agent, or Firm*—Finnegan, Henderson, Farabow, Garrett & Dunner LLP

(57) ABSTRACT

An engine valve actuation system may include an intake valve moveable between a first position that blocks a flow of fluid and a second position that allows a flow of fluid. The system may also include a cam assembly configured to move the intake valve between the first position and the second position. An electromagnetic actuator may be configured to selectively modify a timing of the intake valve in moving from the second position to the first position.

24 Claims, 3 Drawing Sheets

ENGINE VALVE ACTUATION SYSTEM

CROSS REFERENCE TO RELATED APPLICATION

This application is based on and claims priority to Provisional Patent Application No. 60/436,634, filed Dec. 30, 2002, which is incorporated herein by reference.

TECHNICAL FIELD

The present invention is directed to an engine valve actuation system. More particularly, the present invention is directed to a valve actuation system for an internal combustion engine.

BACKGROUND

The operation of an internal combustion engine, such as, for example, a diesel, gasoline, or natural gas engine, may cause the generation of undesirable emissions. These emissions, which may include particulates and nitrous oxide (NOx), are generated when fuel is combusted in a combustion chamber of the engine. An exhaust stroke of an engine piston forces exhaust gas, which may include these emissions, from the engine. If no emission reduction measures are in place, these undesirable emissions will eventually be exhausted to the environment.

Research is currently being directed towards decreasing the amount of undesirable emissions that are exhausted to the environment during the operation of an engine. It is expected that improved engine design and improved control over engine operation may lead to a reduction in the generation of undesirable emissions. Many different approaches, such as, for example, engine gas recirculation and aftertreatments, have been found to reduce the amount of emissions generated during the operation of an engine. Unfortunately, the implementation of these emission reduction approaches may result in a decrease in the overall efficiency of the engine.

Additional efforts are being focused on improving engine efficiency to compensate for the efficiency loss due to the emission reduction systems. One such approach to improving the engine efficiency involves adjusting the actuation timing of the engine valves. For example, the actuation timing of the intake and exhaust valves may be modified to implement a variation on the typical diesel or Otto cycle known as the Miller cycle. In a "late intake" type Miller cycle, the intake valves of the engine are held open during a portion of the compression stroke of the piston.

The engine valves in an internal combustion engine are typically driven by a cam arrangement that is operatively connected to the crankshaft of the engine. The rotation of the crankshaft results in a corresponding rotation of a cam that drives one or more cam followers. The movement of the cam followers results in the actuation of the engine valves. Thus, the shape of the cam governs the timing and duration of the valve actuation.

As described in U.S. Pat. No. 6,237,551 to Macor et al., issued on May 29, 2001, a "late intake" Miller cycle may be implemented in such a cam arrangement by modifying the shape of the cam to overlap the actuation of the intake valve with the start of the compression stroke of the piston. This type of system is relatively inflexible as the timing of the engine valves will remain constant regardless of the vehicle operating conditions.

Hydraulic solutions for providing late intake Miller cycle operation may experience inconsistencies at cold temperatures, for example, during cold engine start and during cold operating conditions. Since fluid such as, for example, lubricating oil, is more viscous when cold, the fluid may not be able to flow through smaller conduits that may be used to operate a late intake Miller cycle operation, resulting in unpredictable operation.

The intake valve actuation system of the present invention may solve one or more of the problems set forth above.

SUMMARY OF THE INVENTION

According to one aspect of the present disclosure, an engine valve actuation system may include an intake valve moveable between a first position that blocks a flow of fluid and a second position that allows a flow of fluid. The system may also include a cam assembly configured to move the intake valve between the first position and the second position. An electromagnetic actuator may be configured to selectively modify a timing of the intake valve in moving from the second position to the first position.

According to another aspect, the present disclosure is directed to a method of controlling an engine having a piston moveable through an intake stroke followed by a compression stroke. The method may include moving an intake valve via a cam between a first position that blocks a flow of fluid and a second position that allows a flow of fluid during the intake stroke of the piston. The method may also include actuating an electromagnetic solenoid associated with the intake valve when the intake valve is away from the first position to selectively modify a timing of the intake valve in moving from the second position to the first position.

It is to be understood that both the foregoing general description and the following detailed description are exemplary and explanatory only and are not restrictive of the invention.

DETAILED DESCRIPTION

Figure 1:
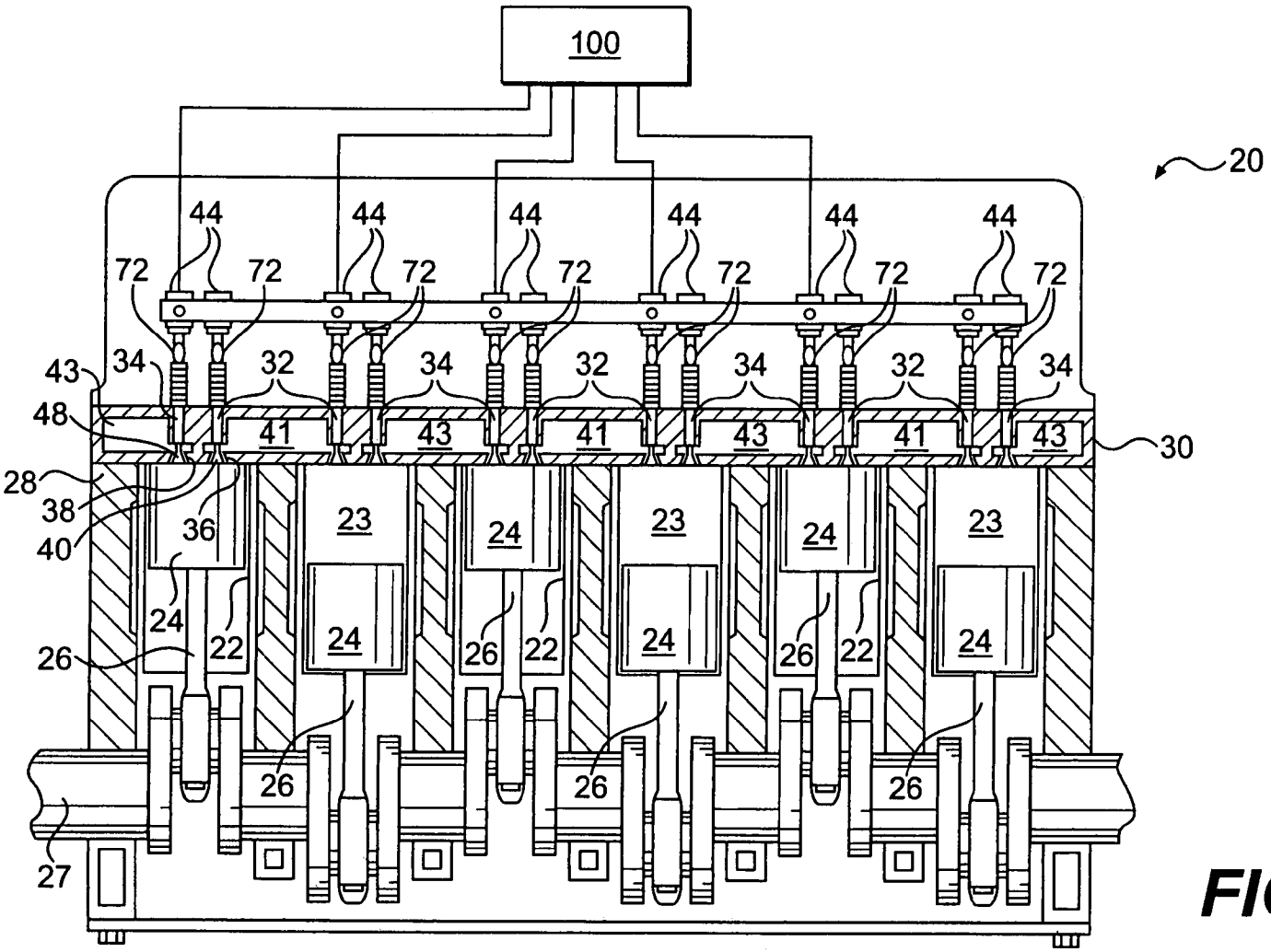
FIG. 1 is a diagrammatic cross-sectional view of an internal combustion engine in accordance with an exemplary embodiment of the present invention.

An exemplary embodiment of an internal combustion engine 20 is illustrated in FIG. 1. For the purposes of the present disclosure, the engine 20 is depicted and described as a four stroke diesel engine. One skilled in the art will recognize, however, that the engine 20 may be any other type of internal combustion engine, such as, for example, a gasoline or natural gas engine.

As illustrated in FIG. 1, the engine 20 includes an engine block 28 that defines a plurality of cylinders 22. A piston 24 is slidably disposed within each cylinder 22. In the illustrated embodiment, the engine 20 includes six cylinders 22 and six associated pistons 24. One skilled in the art will readily recognize that the engine 20 may include a greater or lesser number of pistons 24 and that the pistons 24 may be disposed in an "in-line" configuration, a "V" configuration, or any other conventional configuration.

As also shown in FIG. 1, the engine 20 includes a crankshaft 27 that is rotatably disposed within the engine block 28. A connecting rod 26 connects each piston 24 to the crankshaft 27. Each piston 24 is coupled to the crankshaft 27 so that a sliding motion of the piston 24 within the respective cylinder 22 results in a rotation of the crankshaft 27. Similarly, a rotation of the crankshaft 27 will result in a sliding motion of the piston 24.

The engine 20 also includes a cylinder head 30. The cylinder head 30 defines an intake passageway 41 that leads to at least one intake port 36 for each cylinder 22. The cylinder head 30 may further define two or more intake ports 36 for each cylinder 22.

An intake valve 32 is disposed within each intake port 36. Each intake valve 32 includes a valve element 40 that is configured to selectively block the respective intake port 36. As described in greater detail below, each intake valve 32 may be actuated to move or "lift" the valve element 40 to thereby open the respective intake port 36. In a cylinder 22 having a pair of intake ports 36 and a pair of intake valves 32, the pair of intake valves 32 may be actuated by a single valve actuation assembly or by a pair of valve actuation assemblies.

The cylinder head 30 also defines at least one exhaust port 38 for each cylinder 22. Each exhaust port 38 leads from the respective cylinder 22 to an exhaust passageway 43. The cylinder head 30 may further define two or more exhaust ports 38 for each cylinder 22.

An exhaust valve 34 is disposed within each exhaust port 38. Each exhaust valve 34 includes a valve element 48 that is configured to selectively block the respective exhaust port 38. As described in greater detail below, each exhaust valve 34 may be actuated to move or "lift" valve element 48 to thereby open the respective exhaust port 38. In a cylinder 22 having a pair of exhaust ports 38 and a pair of exhaust valves 34, the pair of exhaust valves 34 may be actuated by a single valve actuation assembly or by a pair of valve actuation assemblies.

Figure 2:
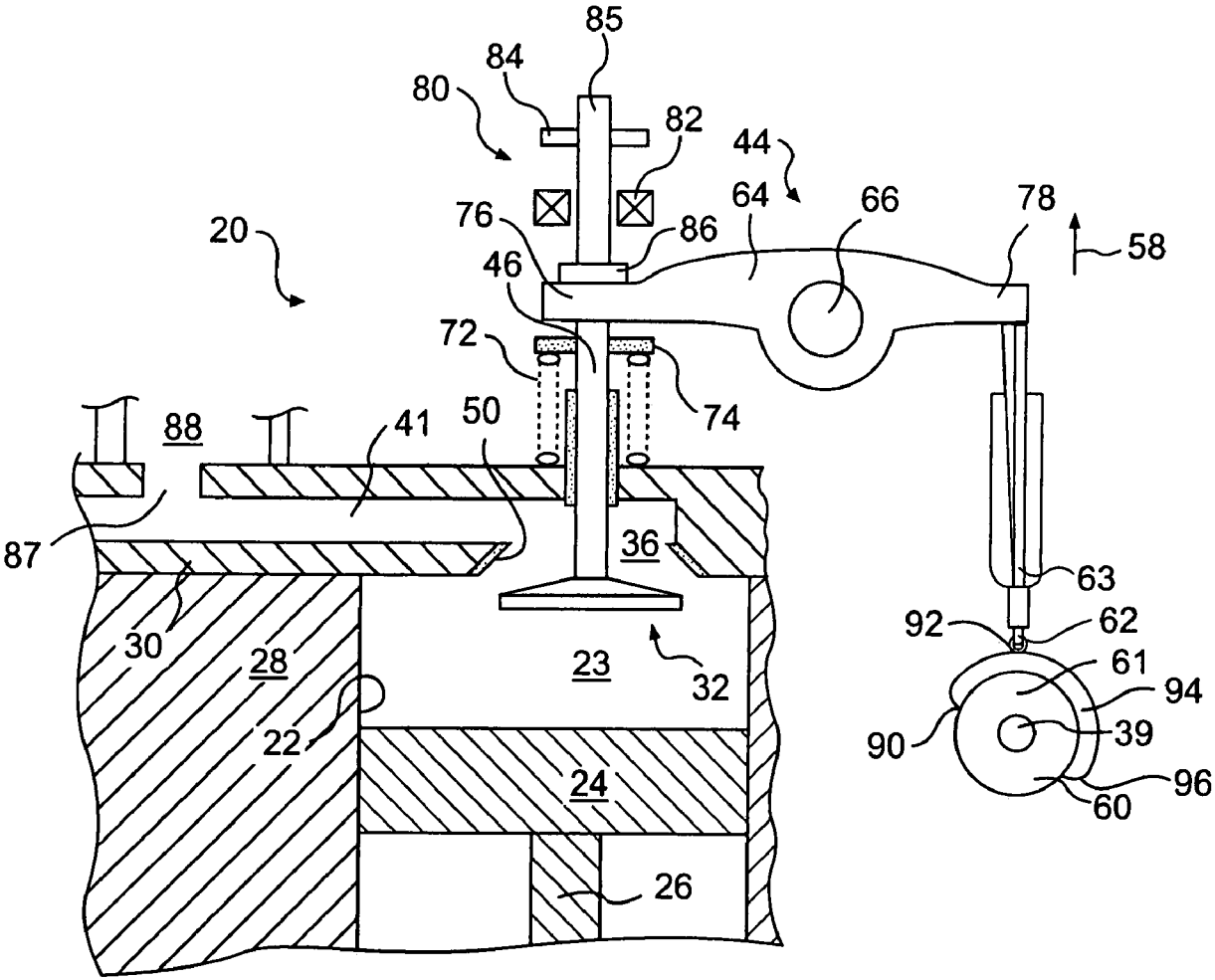
FIG. 2 is a diagrammatic illustration of an exemplary valve actuation assembly for the engine of FIG. 1.

FIG. 2 illustrates an exemplary embodiment of one cylinder 22 of the engine 20. The intake passageway 41 leads from an intake manifold opening 87 to the intake port 36 and into the combustion chamber 23. In addition, the engine 20 includes an intake manifold 88 that may be engaged with cylinder head 30. Intake gases may be directed from the intake manifold 88 through the intake passageway 41 to the combustion chamber 23.

The intake valve element 40 is configured to selectively engage a valve seat 50 in the intake port 36. Intake valve element 40 may be moved between a first position where the intake valve element 40 engages the valve seat 50 to prevent a flow of fluid relative to the intake port 36 and a second position (as illustrated in FIG. 2) where the intake valve element 40 is away from the valve seat 50 to allow a flow of fluid relative to the intake port 36.

The engine 20 also includes a cam shaft 39. The cam shaft 39 is operatively engaged with the crankshaft (not shown) of the engine 20. The cam shaft 39 may be connected with the crankshaft in any manner readily apparent to one skilled in the art where a rotation of the crankshaft will result in a corresponding rotation of the cam shaft 39. For example, the cam shaft 39 may be connected to the crankshaft through a gear train that reduces the rotational speed of the cam shaft 39 to approximately one half of the rotational speed of the crankshaft.

As shown in FIG. 2, an intake cam 60 may also be associated with the cam shaft 39 to rotate with the cam shaft 39. The intake cam 60 may include a cam lobe 61. As will be explained in greater detail below, the shape of the cam lobe 61 on the intake cam 60 will determine, at least in part, the actuation timing of the intake valve element 40. In the exemplary embodiment of FIG. 2, the distance between the outer edge of the cam lobe 61 varies between a first lobe position 90, a second lobe position 92, a third lobe position 94, and a fourth lobe position 96. One skilled in the art will recognize that the intake cam 60 may include a greater number of cam lobes and/or a cam lobe having a different configuration depending upon the desired intake valve actuation timing.

The engine 20 also includes a series of valve actuation assemblies 44 (one of which is illustrated in FIG. 2). One valve actuation assembly 44 may be provided to move the exhaust valve element 48 between the first and second positions. Another valve actuation assembly 44 may be provided to move intake valve element 40 between the first and second positions.

Each valve actuation assembly 44 includes a rocker arm 64 that includes a first end 76, a second end 78, and a pivot point 66. The first end 76 of the rocker arm 64 is operatively engaged with the intake valve element 40 through a valve stem 46. The second end 78 of the rocker arm 64 is operatively associated with a push rod 63.

The valve actuation assembly 44 may also include a valve spring 72. The valve spring 72 may act on the valve stem 46 through a locking nut 74. The valve spring 72 may act to move the intake valve element 40 relative to the cylinder head 30. In the illustrated embodiment, the valve spring 72 acts to bias the intake valve element 40 into the first position, where the intake valve element 40 engages the valve seat 50 to prevent a flow of fluid relative to the intake port 36.

The valve actuation assembly 44 may be driven by the cam 60. As one skilled in the art will recognize, a rotation of the cam 60 will cause the cam follower 62 and associated push rod 63 to periodically reciprocate between an upper position and a lower position. The reciprocating movement of the push rod 63 causes the rocker arm 64 to pivot about the pivot 66. When the push rod 63 moves in the direction indicated by arrow 58, the rocker arm 64 will pivot and move the first end 76 in the opposite direction. The movement of the first end 76 causes each intake valve 32 to lift from the valve seat 50 and open the intake port 36. As the cam 60 continues to rotate, the valve spring 72 will act on the first end 76 of the rocker arm 64 to return each intake valve 32 to the closed position.

In this manner, the shape and orientation of the cam 60 controls the timing of the actuation of the intake valves 32. As one skilled in the art will recognize, the cam 60 may be configured to coordinate the actuation of the intake valves 32 with the movement of the piston 24. For example, the intake valves 32 may be actuated to open the intake ports 36 when the piston 24 is withdrawing within the cylinder 22 to allow air to flow from the intake passageway 41 into the cylinder 22.

A similar valve actuation assembly may be connected to the exhaust valves 34. A second cam (not shown) may be connected to the crankshaft 27 to control the actuation timing of the exhaust valves 34. The exhaust valves 34 may be actuated to open the exhaust ports 38 when the piston 24 is advancing within the cylinder 22 to allow exhaust to flow from the cylinder 22 into the exhaust passageway 43.

As shown in FIG. 2, the valve actuation assembly 44 also includes an electromagnetic actuator 80, for example, a latching solenoid, disposed at the first end 76 of the rocker arm 64. The actuator 80 may include a solenoid coil 82 and an armature 84 coupled with a core 85. The armature 84 and core 85 are movable relative to the solenoid coil 82. For example, the armature 84 and core 85 may be slidably movable through the solenoid coil 82. The actuator 80 may be operable to engage the first end 76 of the rocker arm 64 via an end 86 of the core 85.

As shown in FIG. 1, a controller 100 may be connected to each valve actuation assembly 44. The controller 100 may include an electronic control module that has a microprocessor and a memory. As is known to those skilled in the art, the memory is connected to the microprocessor and stores an instruction set and variables. Associated with the microprocessor and part of electronic control module are various other known circuits such as, for example, power supply circuitry, signal conditioning circuitry, and solenoid driver circuitry, among others.

The controller 100 may be programmed to control one or more aspects of the operation of the engine 20. For example, the controller 100 may be programmed to control the valve actuation assembly, the fuel injection system, and any other function readily apparent to one skilled in the art. The controller 100 may control the engine 20 based on the current operating conditions of the engine and/or instructions received from an operator.

The controller 100 may be further programmed to receive information from one or more sensors operatively connected with the engine 20. Each of the sensors may be configured to sense one or more operational parameters of the engine 20. For example, the engine 20 may be equipped with sensors configured to sense one or more of the following: the temperature of the engine coolant, the temperature of the engine, the ambient air temperature, the engine speed, the load on the engine, and the intake air pressure.

Figure 3:
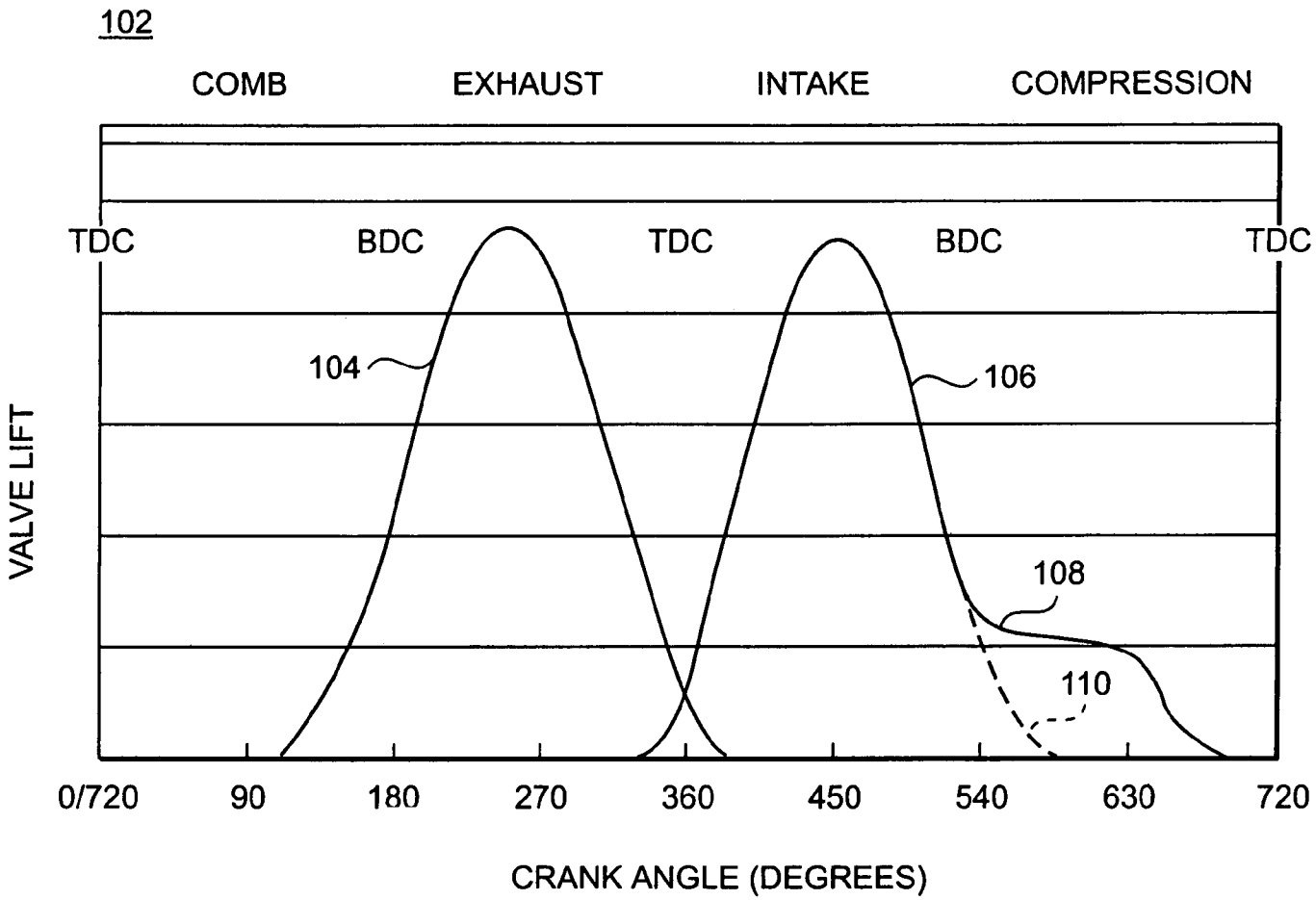
FIG. 3 is a graphic illustration of an exemplary valve actuation as a function of engine crank angle for an engine operating in accordance with the present invention.

The engine 20 may be further equipped with a sensor configured to monitor the crank angle of the crankshaft 27 to thereby determine the position of the pistons 24 within their respective cylinders 22. The crank angle of the crankshaft 27 is also related to actuation timing of the intake valves 32 and the exhaust valves 34. An exemplary graph 102 indicating the relationship between valve actuation timing and crank angle is illustrated in FIG. 3. As shown by the graph 102, exhaust valve actuation 104 is timed to substantially coincide with the exhaust stroke of the piston 24 and intake valve actuation 106 is timed to substantially coincide with the intake stroke of the piston 24. FIG. 3 illustrates valve lift for an exemplary late intake closing 108 and an exemplary conventional closing 110.

INDUSTRIAL APPLICABILITY

Based on information provided by the engine sensors, the controller 100 may operate each valve actuation assembly 44 to selectively implement a late intake Miller cycle or a conventional Otto cycle for each cylinder 22 of the engine 20. Under normal operating conditions, implementation of the late intake Miller cycle will increase the overall efficiency of the engine 20.

The following discussion describes the implementation of a late intake Miller cycle in a single cylinder 22 of the engine 20. One skilled in the art will recognize that the system of the present invention may be used to selectively implement a late intake Miller cycle in all cylinders of the engine 20 in the same or a similar manner. In addition, the disclosed system may be used to implement other valve actuation variations on the conventional diesel cycle, such as, for example, an exhaust Miller cycle.

When the engine 20 is operating under normal operating conditions, the controller 100 implements a late intake Miller cycle by applying a first current to the solenoid coil 82 during a first portion of the compression stroke of the piston 24. The current generates a magnetic field at the solenoid coil 82 that forces the armature 84 and core 85 to an extended position in a first direction. For example, the solenoid coil 82 may attract the armature 84 and core 85 in a direction toward the solenoid coil 82 such that the end 86 of the core 85 engages the first end 76 of the rocker arm 64 to hold the intake valve 32 open for a first portion of the compression stroke of the piston 24.

In an exemplary embodiment, the electromagnetic actuator 80 is a latching solenoid. In such an embodiment, the armature 84 and core 85 remain in the extended position even when the first current is no longer applied to the solenoid coil 82. When it is desired to allow the intake valve 32 to close, a second current is applied to the solenoid coil 82 in a direction opposite to the first current. The second current generates a magnetic field at the solenoid coil 82 that forces the armature 84 and core 85 to a retracted position in a second direction, opposite to the first direction. For example, the solenoid coil 82 may repel the armature 84 and core 85 in a direction away from the solenoid coil 82 such that the end 86 of the core 85 no longer engages the first end 76 of the rocker arm 64 and allows the intake valve 32 to close.

It should be appreciated that an additional current could be applied to the solenoid coil 82 as the force of the spring 72 begins to close the valve 32 so as to reduce the impact force of the valve element 48 on the valve seat 50. This additional current may have a value between the first and second currents. The additional current may return the armature 84 and core 85 toward the extended position and may retain the armature 84 and core 85 is an extended position.

An exemplary late intake closing 108 is illustrated in FIG. 3. As shown, the intake valve actuation 106 is extended into a portion of the compression stroke of the piston 24. This allows some of the air in the cylinder 22 to escape. The amount of air allowed to escape the cylinder 22 may be controlled by adjusting the crank angle at which the first current is applied to the solenoid coil 82 of the electromagnetic actuator 80. The first current may be applied to the solenoid coil 82 at an earlier crank angle to decrease the amount of escaping air or at a later crank angle to increase the amount of escaping air.

The electromagnetic actuator 80 may also be actuated to reduce the velocity at which the intake valves 32 are closed. This may prevent the valve elements 40 from being damaged when closing the intake ports 36. For example, regardless of whether the controller 100 is implementing a late intake Miller cycle or a conventional diesel cycle, a current may be applied to the solenoid coil 82 at a time when the intake valve 32 is closing. For example, during a late intake Miller cycle, this current is applied after the previously described first and second currents are applied. The current generates a magnetic field at the solenoid coil 82 that forces the armature 84 and core 85 to the extended position in the first direction to engage the first end 76 of the rocker arm 64. The force of the magnetic field is strong enough to stop the closing of the intake valve 32, but not so strong as to cause damage to the valve stem 46 or rocker arm 64. A reverse current may be applied shortly thereafter to allow the intake valve 32 to continue closing without significant delay, while slowing the closing momentum of the intake valve 32 to reduce the impact of the valve element 40 against the valve seat 50. The effect of the current for reducing intake valve closing velocity can be seen from the gradual taper of the late intake closing curve 108 as the compression stroke of the piston 24 approaches top dead center.

It should be appreciated that other alternatives exist for reducing the closing speed of the valve element 32. For example, an impact absorber (not shown) may be placed between the core 85 and the rocker arm 64. The impact absorber may include a spring/damper element, for example, a self-contained hydraulic, pneumatic, or elastomeric element. As another example, a cam (not shown) may be used to reduce the closing speed of the valve element 32. Such a cam may be referred to as a "decelerating" or "handoff" cam because it reduces the closing speed of the valve element 32 at the handoff or impact point.

The disclosed engine valve actuation system may selectively alter the timing of the intake and/or exhaust valve actuation of an internal combustion engine. The actuation of the engine valves may be based on sensed operating conditions of the engine. For example, the engine valve actuation system may implement a late intake Miller cycle when the engine is operating under normal operating conditions, and the late intake Miller cycle may be disengaged when the engine is operating under other conditions. The engine valve actuation system may be used to implement late intake Miller cycle during cold engine start and other cold engine conditions, since the operational reliability of the electromagnetic actuator 80 is not dependent on operating temperature. Thus, the present invention provides a flexible engine valve actuation system that provides for both enhanced cold starting capability and fuel efficiency gains.

It will be apparent to those skilled in the art that various modifications and variations can be made in the disclosed engine valve actuation system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. An engine valve actuation system, comprising:

an intake valve;

a cam assembly configured to open and close an intake port associated with the intake valve; and a separate actuator electromagnetically operated to selectively close the intake port at a different timing than the cam assembly, wherein the separate actuator is a latching solenoid including a solenoid coil and an armature coupled with a core, the armature and the core being movable together relative to the solenoid coil, the separate actuator being configured such that the armature and the core remain at a second position when a first current is removed.

2. The engine valve actuation system of claim 1, further including a pivotable rocker arm operably coupling the cam assembly with the intake valve.

3. The engine valve actuation system of claim 2, wherein the core includes an end configured to selectively engage the rocker arm opposite to the intake valve.

4. The engine valve actuation system of claim 3, further including a controller configured to move the armature and the core between a first position and the second position.

5. The engine valve actuation system of claim 4, wherein the controller is configured to apply the first current to the solenoid coil to move the armature and the core from the first position to the second position to engage the rocker arm to modify a timing of the intake valve.

6. The engine valve actuation system of claim 5, wherein the controller is configured to apply a second current to the solenoid coil to move the armature and the core from the second position to the first position to disengage from the rocker arm, the second current being opposite to the first current.

7. The engine valve actuation system of claim 6, wherein the electromagnetic actuator is configured such that the armature and the core remain at the second position when the controller removes the second current.

8. The engine valve actuation system of claim 6, wherein the controller is configured to apply a third current to the solenoid coil to move the armature and the core from the first position to the second position to engage the rocker arm to slow a closing velocity of the intake valve.

9. A method of controlling an engine having a piston moveable through an intake stroke followed by a compression stroke, comprising:

opening and closing an intake port associated with an intake valve via a cam; and operating a separate actuator having an electromagnetic latching solenoid associated with the intake valve when the intake port is open to selectively close the intake port at a different timing than the cam assembly, wherein operating includes controllable moving a coupled armature and core of the separate actuator between a first position and a second position by applying a first current to a solenoid coil of the separate actuator, and wherein the coupled armature stays in the second position after the first current is removed.

10. The method of claim 9, wherein controllably moving the coupled armature and core between the first position and the second position includes engaging a rocker arm operably coupled with the intake valve to modify a timing of the intake valve.

11. The method of claim 10, wherein controllably moving includes applying a second current to the solenoid coil to move the coupled armature and core from the second position to the first position to disengage from the rocker arm, the second current being opposite to the first current.

12. The method of claim 11, further including applying a third current to the solenoid coil to move the coupled armature and core from the first position to the second position to engage the rocker arm to slow a closing velocity of the intake valve.

13. A valve actuation system for an engine having at least one cylinder and at least one intake port associated with the at least one cylinder, comprising:

an intake valve;

a cam assembly mechanically linked to the intake valve to open and close the at least one intake port;

latching solenoid including a solenoid coil and an armature coupled with a core, the armature and the core being movable together relative to the solenoid coil, the latching solenoid being selectively mechanically linked to the intake valve to selectively close the at least one intake port at a different timing than the cam assembly; and a controller configured to apply a first current to the solenoid coil to move the armature and the core between a first position and a second position, wherein the latching solenoid is configured such that the armature and the core remain at the first position when the controller removes the first current.

14. The engine valve actuation system of claim 13, further including a pivotable rocker arm operably coupling the cam assembly with the intake valve.

15. The engine valve actuation system of claim 14, wherein the core includes an end configured to selectively engage the rocker arm opposite to the intake valve.

16. The engine valve actuation system of claim 15, wherein moving the armature and the core from the first position to the second position engages the rocker arm to modify a timing of the intake valve.

17. The engine valve actuation system of claim 16, wherein the controller is configured to apply a second current to the solenoid coil to move the armature and the core from the second position to the first position to disengage from the rocker arm, the second current being opposite to the first current.

18. The engine valve actuation system of claim 17, wherein the latching solenoid is configured such that the armature and the core remain at the second position when the controller removes the second current.

19. The engine valve actuation system of claim 17, wherein the controller is configured to apply a third current to the solenoid coil to move the armature and the core from the first position to the second position to engage the rocker arm to slow a closing velocity of the intake valve.

20. A method of controlling an engine having a piston moveable through an intake stroke followed by a compression stroke, comprising:

moving an intake valve to open and close an intake port via a cam that is mechanically linked to the intake valve; and moving the intake valve to close the intake port via an electromagnetic actuator that is selectively mechanically linked to the intake valve, wherein the electromagnetic actuator is a latching solenoid configured to hold the intake valve open after the cam disengage from the intake valve until a first current is applied to the electromagnetic actuator.

21. The method of claim 20, wherein moving the intake valve to close the intake port via an electromagnet actuator includes controllably moving a coupled armature and core of the electromagnetic actuator between a first position and a second position.

22. The method of claim 21, wherein moving the intake valve to close the intake port via an electromagnet actuator includes applying the first current to a solenoid coil of the electromagnetic actuator to move the coupled armature and core from the first position to the second position to engage a rocker arm operably coupled with the intake valve to modify a timing of the intake valve.

23. The method of claim 22, wherein controllably moving includes applying a second current to the solenoid coil to move the coupled armature and core from the second position to the first position to disengage from the rocker arm, the second current being opposite to the first current.

24. The method of claim 23, further including applying a third current to the solenoid coil to move the coupled armature and core from the first position to the second position to engage the rocker arm to slow a closing velocity of the intake valve.

* * * * *